US006308698B1

(12) United States Patent
Shioi et al.

(10) Patent No.: US 6,308,698 B1
(45) Date of Patent: Oct. 30, 2001

(54) METHOD AND APPARATUS FOR CONTROLLING FUEL INJECTION IN DIESEL ENGINE

(75) Inventors: Kenzo Shioi; Keiichi Iida; Tomoo Nishikawa, all of Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/579,890

(22) Filed: May 26, 2000

(30) Foreign Application Priority Data

May 31, 1999 (JP) ..... 11-152505

(51) Int. Cl.[7] ..... F02D 41/00
(52) U.S. Cl. ..... 123/680; 123/486
(58) Field of Search ..... 123/680, 486, 123/682, 357, 478

(56) References Cited

U.S. PATENT DOCUMENTS

| | | | | |
|---|---|---|---|---|
| 4,359,991 | | 11/1982 | Stumpp et al. | 123/478 |
| 4,428,354 | * | 1/1984 | Sundeen et al. | 123/568 |
| 4,589,392 | | 5/1986 | Wirz | 123/357 |
| 4,791,904 | * | 12/1988 | Grieshaber et al. | 123/479 |
| 5,024,196 | * | 6/1991 | Ohuchi | 123/339 |
| 5,086,739 | * | 2/1992 | Frankle | 123/357 |
| 6,021,755 | * | 2/2000 | Maddock et al. | 123/361 |
| 6,065,449 | * | 5/2000 | Fukuma | 123/436 |
| 6,152,107 | * | 11/2000 | Barnes et al. | 123/357 |

FOREIGN PATENT DOCUMENTS 7-151007 6/1995 (JP) .

* cited by examiner

*Primary Examiner*—Henry C. Yuen
*Assistant Examiner*—Mahmoud Gimie
(74) *Attorney, Agent, or Firm*—McCormick, Paulding & Huber LLP

(57) ABSTRACT

An arrangement for controlling fuel injection in a diesel engine to prevent generation of smoke even when an accelerator pedal is stamped during idling. A basic amount of fuel injection $Q_{base}$ is determined from an engine revolution speed Ne and accelerator opening degree Ac. A maximum amount of fuel injection $Q_{MAF}$ is determined from the engine revolution speed Ne and an intake air flow rate MAF. It is then determined whether a first condition of vehicle speed being zero and a second condition of accelerator opening degree being not zero both hold true. The maximum amount of fuel injection $Q_{MAF}$ is corrected to a smaller value $Q_{lmt}$ when both the first and second conditions are met. In this case, the basic amount of fuel injection Qbase is compared with the reduced maximum amount of fuel injection $Q_{lmt}$ and the smaller one is selected as a target amount of fuel injection $Q_{fnl}$.

12 Claims, 5 Drawing Sheets

| t | FAC |
|---|---|
| $t_0$ | 0.8 |
| $t_1$ | 0.8 + C |
| $t_2$ | 0.8 + 2C |
| ⋮ | ⋮ |
| $t_E$ | 1 |

METHOD AND APPARATUS FOR CONTROLLING FUEL INJECTION IN DIESEL ENGINE

BACKGROUND OF THE INVENTION

1. Field of the Invention

The present invention relates to a method and apparatus for controlling an amount of fuel to be injected into a diesel engine, and more particularly to a method and apparatus that can reduce or prevent generation of smoke upon steep increase of engine revolution speed.

2. Description of the Related Art

Conventionally, a basic amount of fuel injection in a diesel engine is determined based on an engine revolution speed and an accelerator opening degree, and this basic value is modified based on temperature of water flowing in the engine and intake air temperature in order to determine an ultimate (or target) amount of fuel injection.

With such modification, however, a larger amount of fuel tends to be injected relative to an amount of intake air when the engine runs under a heavy load condition or a vehicle cruises at high altitude. This often results in generation of smoke from the engine. In order to prevent it, Japanese Patent Application Laid-Open Publication Nos. 54-111015 and 7-151007 published Aug. 31, 1979 and Jun. 13, 1995 respectively proposed a technique of limiting an amount of fuel injection within a certain range. Specifically, an intake air sensor detects an amount (flow rate) of intake air, and a maximum amount of fuel injection (limit value) that does not allow smoke to be emitted more than a predetermined value relative to the amount of intake air is determined. Subsequently, the limit value is compared with a basic amount of fuel injection, and the smaller one is selected as the target amount of fuel injection. By doing so, the target amount of fuel injection is controlled to be always smaller than the predetermined upper limit. Accordingly, an amount of smoke generated from the engine stays within a prescribed range under any engine operating condition.

Incidentally, a vehicle driver sometimes stamps an accelerator pedal intentionally in order to promote warming up of the engine soon after the engine is started up. In this situation, the vehicle is still on the road (vehicle speed is zero) and a transmission gear position is neutral. Since the gear position is neutral, the engine is running under no load so that the engine revolution speed steeply increases upon stamping of the accelerator pedal.

At this point, the following problems will occur. Referring to FIG. 6 of the accompanying drawings, when the accelerator pedal opening Ac increases quickly, an amount of fuel injection Q (solid line) correspondingly increases quickly, and the engine revolution speed Ne (solid line) increases steeply with a certain delay. This temporarily reduces an amount of intake air admitted into a combustion chamber of the engine (referred to as "actual MAF" (Mass Air Flow rate)) and a relative amount of fuel Q to the actual MAF becomes larger, thereby generating smoke.

Although the maximum amount of fuel injection is determined from a detection value of the intake air sensor (i.e., MAF sensor), this sensor is located near an inlet of an intake air pipe apart from the engine combustion chamber so that the detection value (MAF sensor value) has a delay relative to the actual MAF ($\Delta t$ in FIG. 6). Because of this, if the maximum amount of fuel injection is determined based on the MAF sensor value and the target amount of fuel injection is controlled with such maximum value, the controlling is performed with a certain delay and tolerates emission of smoke.

SUMMARY OF THE INVENTION

An object of the present invention is to overcome the above described problems.

According to one aspect of the present invention, there is provided an arrangement for controlling fuel injection in a diesel engine, including a first determination unit for determining a basic amount of fuel injection from an engine revolution speed and accelerator opening degree, a second determination unit for determining a maximum amount of fuel injection from the engine revolution speed and an amount of intake air (intake air flow rate), a third determination unit for determining whether a first condition of vehicle speed being zero and a second condition of accelerator opening degree being not zero both hold true, a correction unit for correcting the maximum amount of fuel injection to a smaller value when both the first and second conditions hold true, and a comparison unit for comparing the basic amount of fuel injection with the (corrected) maximum amount of fuel injection and selecting the smaller one as a target amount of fuel injection. When both the first and second conditions are met, the reduced maximum amount of fuel injection is compared with the basic amount of fuel injection to choose the smaller one. On the other hand, if at least one of the first and second conditions holds untrue, then the maximum amount of fuel injection without any modification is compared with the basic value.

The correction unit may obtain the corrected maximum amount of fuel injection by multiplying the maximum amount of fuel injection by a correction coefficient less than one. The correction coefficient may increase with time.

Additional objects, benefits and advantages of the present invention will become apparent to those skilled in the art to which this invention relates from the subsequent description of the embodiment(s) and appended claims, taken in conjunction with the accompanying drawings.

DETAILED DESCRIPTION OF THE INVENTION

Now, an embodiment of the present invention will be described in reference to the accompanying drawings.

Figure 5:
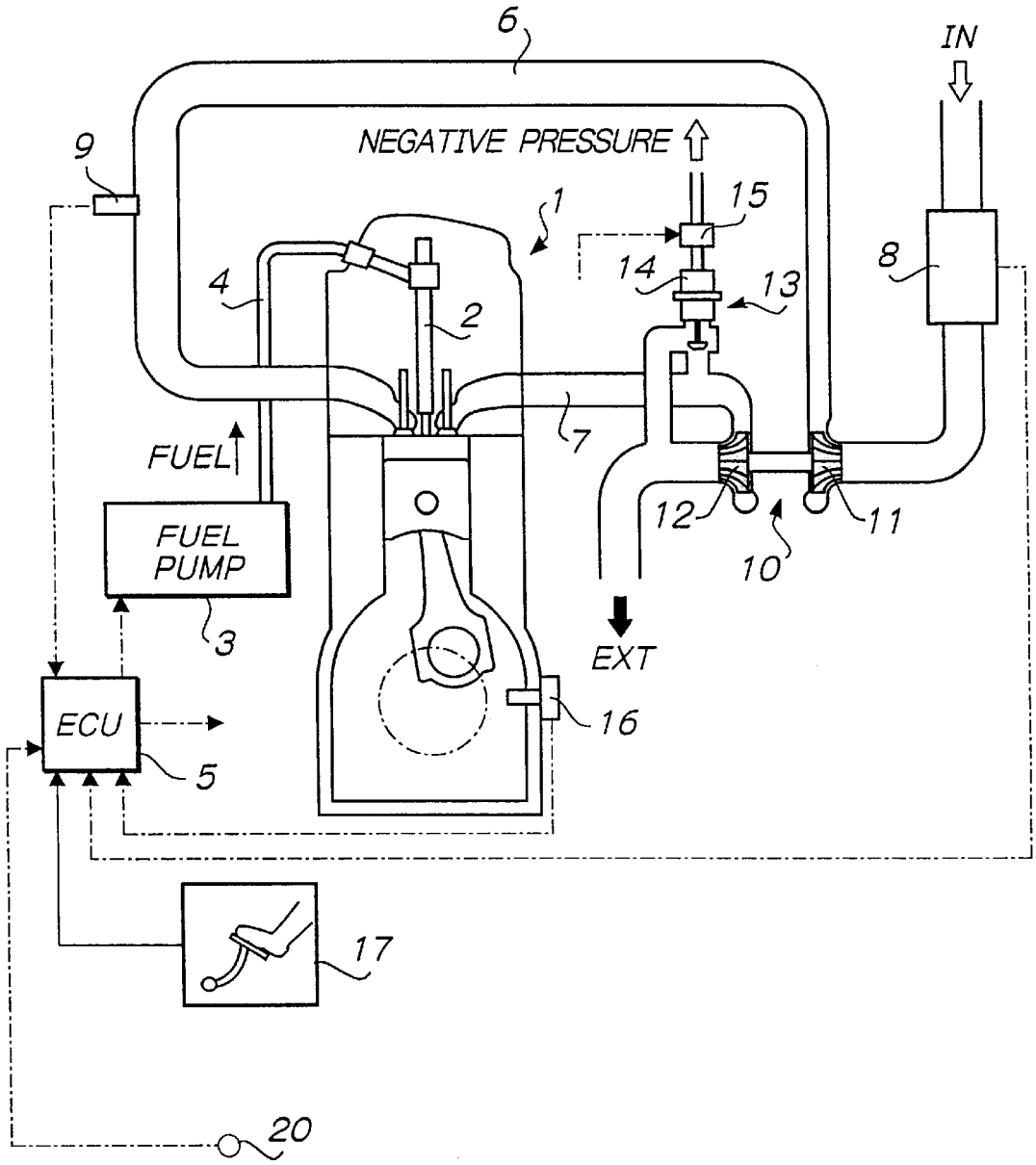
FIG. 5 schematically illustrates an engine equipped with the apparatus of the present invention.

Referring first to FIG. 5, illustrated is a fuel injection system in a diesel engine 1 according to the present invention. The diesel engine 1 has at least one fuel injection nozzle 2 for injecting fuel into an associated combustion chamber. For the sake of simplicity, the following description only deals with the fuel injection nozzle 2 illustrated.

The fuel injection nozzle 2 is supplied with pressurized fuel from a fuel injection pump 3 via a pipe 4. The fuel pump 3 is a distribution-type in this particular embodiment. An amount (rate) of fuel delivery is determined by an electronic control unit (ECU) 5. The fuel pump 3 has two electromagnetic valves (not shown), which are used to determine the start of fuel delivery and the end respectively. ECU 5 switches these electromagnetic valves such that an appropriate amount of pressurized fuel is fed to the nozzle 2 at an appropriate timing.

An intake air passage 6 extends to the engine 1 and an exhaust passage 7 extends from the engine 1. MAE sensor 8, which serves as a sensor for detecting an amount of intake air, is provided on the intake air pipe 6 near the inlet thereof. An output of the MAF sensor 8 is sent to ECU 5. Accordingly, the amount of intake air can be detected while the engine is operating. It should be noted here that the term "amount of intake air" is a mass flow rate of intake air in this specification. Downstream of the MAF sensor 8 on the intake air pipe 6, provided is an intake air pressure sensor 9. This sensor also outputs its detection result to ECU 5. Accordingly, the intake air pressure can be detected while the engine is running.

The engine 1 is further equipped with a turbocharger 10. A compressor 11 of the turbocharger 10 is attached to the intake air pipe 6 between the MAF sensor 8 and intake air pressure sensor 9. A waste gate 13 is provided on the exhaust pipe 7 upstream of a turbine 12 of the turbocharger 10 to control the exhaust gas to be supplied to the turbine 12. The waste gate 13 includes a negative pressure actuator 14 and an electromagnetic valve 15 for feeding or stopping negative pressure (upwardly directing unshaded arrow) to the actuator 14. Based on the output of the intake air pressure sensor 9, the waste gate electromagnetic valve 15 is opened or closed under the control of ECU 5. When the waste gate 13 is opened, the exhaust gas from the engine 1 bypasses the turbine 12 and is expelled to the outside as indicated by the shaded arrow labeled EXT.

To ECU 5, connected are an engine revolution speed sensor 16 and an accelerator opening degree sensor 17. Accordingly, ECU 5 is able to detect the engine revolution speed and the degree of accelerator opening. A vehicle speed sensor 20 is also connected to ECU 5 to particularly determine whether the vehicle is stopped or running.

Figure 1:
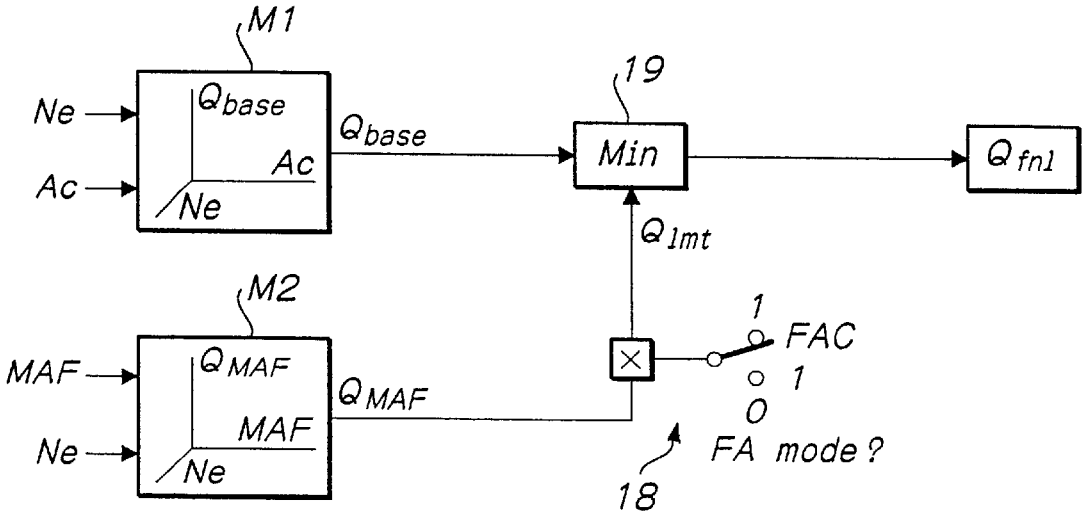
FIG. 1 illustrates a block diagram of various elements in an apparatus of the present invention, which is useful to explain fuel injection control according to the present invention.

Referring now to FIG. 1, a method of controlling an amount of fuel injection according to the present invention will be described.

ECU 5 has two maps M1 and M2 which are prepared from experiments and/or theoretical calculations. The map M1 is a three-dimensional map to determine a basic amount of fuel injection $Q_{base}$. As an engine revolution speed Ne detected by the engine revolution speed sensor 16 and an accelerator opening degree Ac detected by the accelerator sensor 17 are input, the basic amount of fuel injection $Q_{base}$ is uniquely determined by the map M1. The map M2 is a three-dimensional map to determine a maximum amount of fuel injection $Q_{MAF}$. Using the engine revolution speed Ne and the intake air flow rate MAF detected by thee MAF sensor 8, the maximum amount of fuel injection $Q_{MAF}$ is uniquely determined from the map M2.

It should be noted that determination of the basic amount of fuel injection $Q_{base}$ using the map M1 is known in the field of diesel engine. In general, temperature of water flowing in the engine 1 and intake air temperature are also considered to correct the basic amount of fuel injection $Q_{base}$, but for the sake of easy understanding of the present invention, such correction is not performed here.

The map M2 particularly provides a maximum amount of fuel injection relative to the intake air flow rate MAF. Generally an amount of fuel injection increases relative to the amount of intake air in order to ensure an appropriate output under a heavy load condition. Similarly, when the vehicle is running at high altitude, the air density drops so that the amount of fuel injection increases relative to the amount of intake air. Specifically, the air/fuel ratio drops and the mixture of air and fuel becomes "fuel rich". In this case, if the amount of fuel injection is excessive, smoke is generated. The map M2 is provided here in order to prevent generation of the smoke by limiting the amount of fuel injection. The map M2 determines the maximum amount of fuel injection $Q_{MAF}$ such that the air/fuel ratio has a predetermined value near and below a "smoke generation limit" (over which limit smoke is generated). If the target amount of fuel injection is determined not to exceed this value, it is always possible to prevent generation of smoke. Concrete way of this control will be described later.

Now, determination of target amount of fuel injection $Q_{fnl}$ will be described in reference to FIG. 1.

A mode switch 18 is turned to "1" when predetermined conditions are met (will be described), and this situation is referred to as "free accelerator (FA) mode". The maximum amount of fuel injection $Q_{MAF}$ is then multiplied by a coefficient FAC less than one to provide a new (reduced) maximum amount of fuel injection $Q_{lmt}$. When the predetermined conditions are not met, on the other hand, the mode switch 18 is turned to "0", and the value $Q_{MAF}$ is multiplied by one. In other words, the value $Q_{MAF}$ itself is output as the new maximum amount of fuel injection $Q_{lmt}$.

The basic amount of fuel injection $Q_{base}$ determined from the map M1 and the new maximum amount of fuel injection $Q_{lmt}$ output from the mode switch 18 are input to a comparator 19. The comparator 19 outputs the smaller one as a target amount of fuel injection $Q_{fnl}$. If the two values $Q_{base}$ and $Q_{lmt}$ are equal to each other, any of these may be output. In this particular embodiment, the comparator 19 is programmed to output the basic value $Q_{base}$. In this manner, when $Q_{base} \leqq Q_{lmt}$, then $Q_{base}$ is used as $Q_{fnl}$, and when $Q_{base} > Q_{lmt}$, then $Q_{lmt}$ is used as $Q_{fnl}$. Thus, the value $Q_{fnl}$ is always smaller than the value $Q_{lmt}$, and the air/fuel ratio is always maintained below the smoke generation limit. Consequently, it is possible to prevent generation of smoke. Particularly in the FA mode, the maximum amount of fuel injection $Q_{MAF}$ is corrected to a smaller value so that the target amount of fuel injection $Q_{fnl}$ is further decreased.

Next, the above described fuel injection control will be described in reference to the flowcharts shown in FIGS. 2 and 3. It should be noted that these flowcharts are repeatedly executed by ECU 5 at predetermined intervals.

Figure 2:
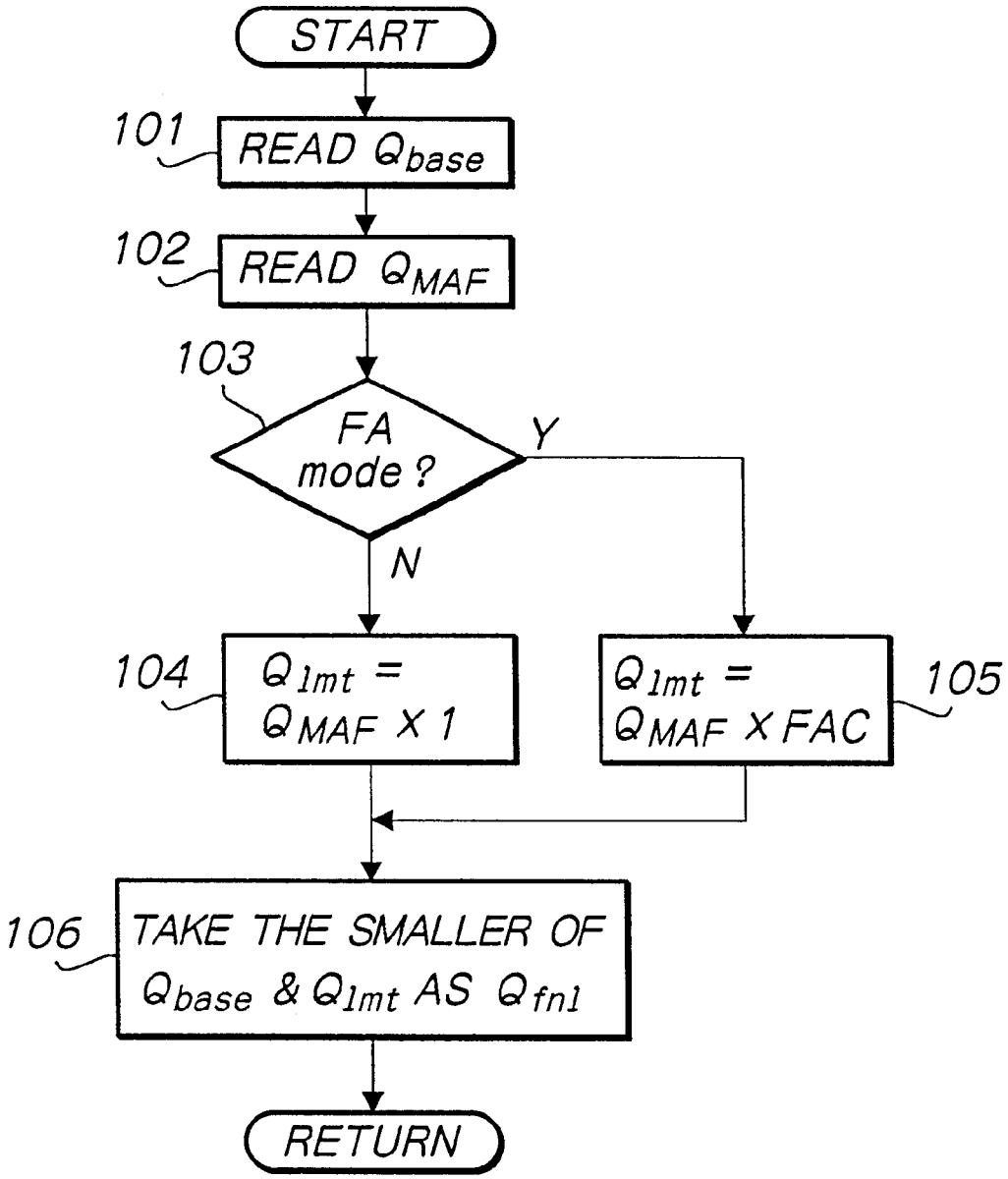
FIG. 2 illustrates a main flowchart corresponding to the block diagram shown in FIG. 1.
Figures 3, 4:
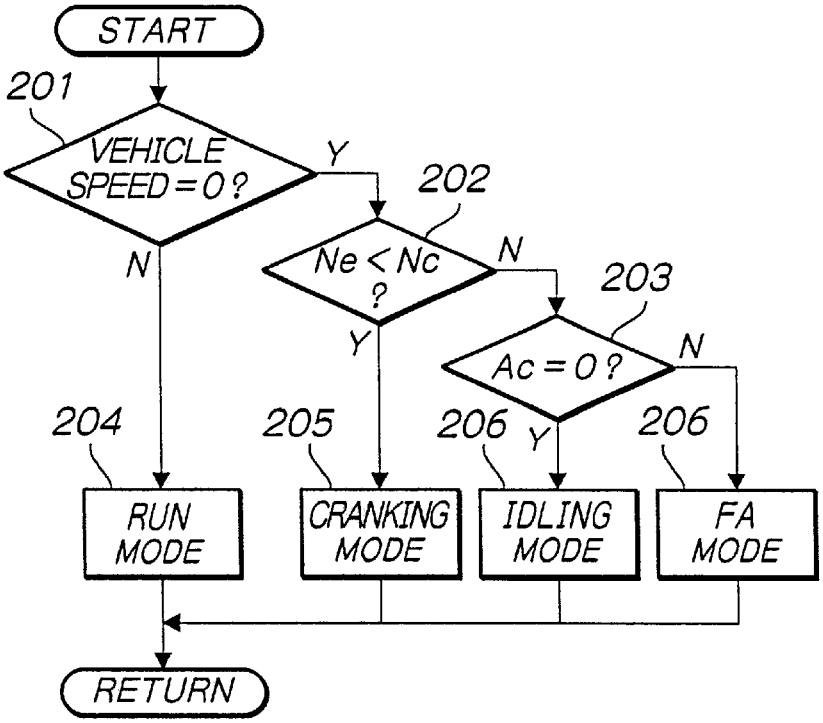
FIG. 3 illustrates a flowchart utilized in determining a drive mode.
FIG. 4 illustrates a table of correction coefficient which increases with time.

Referring first to FIG. 3, drive mode determination will be described prior to the main flowchart of FIG. 2. At step 201 ECU 5 determines from the output of the vehicle speed sensor 20 whether the vehicle speed sensor 20 is zero or not. If the vehicle speed is not zero, the program proceeds to step 204 and enters a "run" mode, not the FA mode. If the vehicle speed is zero, the program proceeds to step 202 to compare the engine revolution speed Ne with a predetermined cranking rotation speed threshold value Nc. If Ne<Nc, it is determined that cranking is taking place for engine starting up, and the program proceeds to step 205 thereby entering a "cranking" mode, not the FA mode. If Ne≧Nc, it is determined that the engine is self operating and the program proceeds to step 203 to determine whether the accelerator opening degree is zero. If it is zero, the program proceeds to step 206 and enters an "idling" mode, not the FA mode. If Ac is not zero, on the other hand, it is determined that a driver stamps an accelerator pedal. This is accelerator pedal stamping with no load, and the program proceeds to step 207 thereby entering the FA mode.

Referring to FIG. 2, at step 101 ECU 5 reads the basic amount of fuel injection $Q_{base}$ from the map M1. At step 102 ECU 5 reads the maximum amount of fuel injection $Q_{MAF}$ from the map M2. At step 103 ECU 5 determines whether the current drive mode is the FA mode.

If the current mode is not the FA mode, the program proceeds to step 104 to multiply the maximum amount of fuel injection $Q_{MAF}$ by one to obtain the new maximum amount of fuel injection $Q_{lmt}$. In this case, the maximum amount of fuel injection $Q_{MAF}$ itself is used as the new value $Q_{lmt}$. On the other hand, if the FA mode is established, the program proceeds to step 105 to multiply the maximum amount of fuel injection $Q_{MAF}$ by a correction coefficient FAC to obtain the new maximum amount of fuel injection $Q_{lmt}$. After that, the program proceeds to step 106 to take the smaller of the basic value $Q_{base}$ and the new maximum value $Q_{lmt}$ to determine a target amount of fuel injection $Q_{fnl}$. In this manner, the single routine of control is completed.

With such target amount of fuel injection $Q_{fnl}$, ECU 5 switches the electromagnetic valves of the fuel pump 3 and adjusts the fuel delivery to the nozzle 2.

Figure 6:
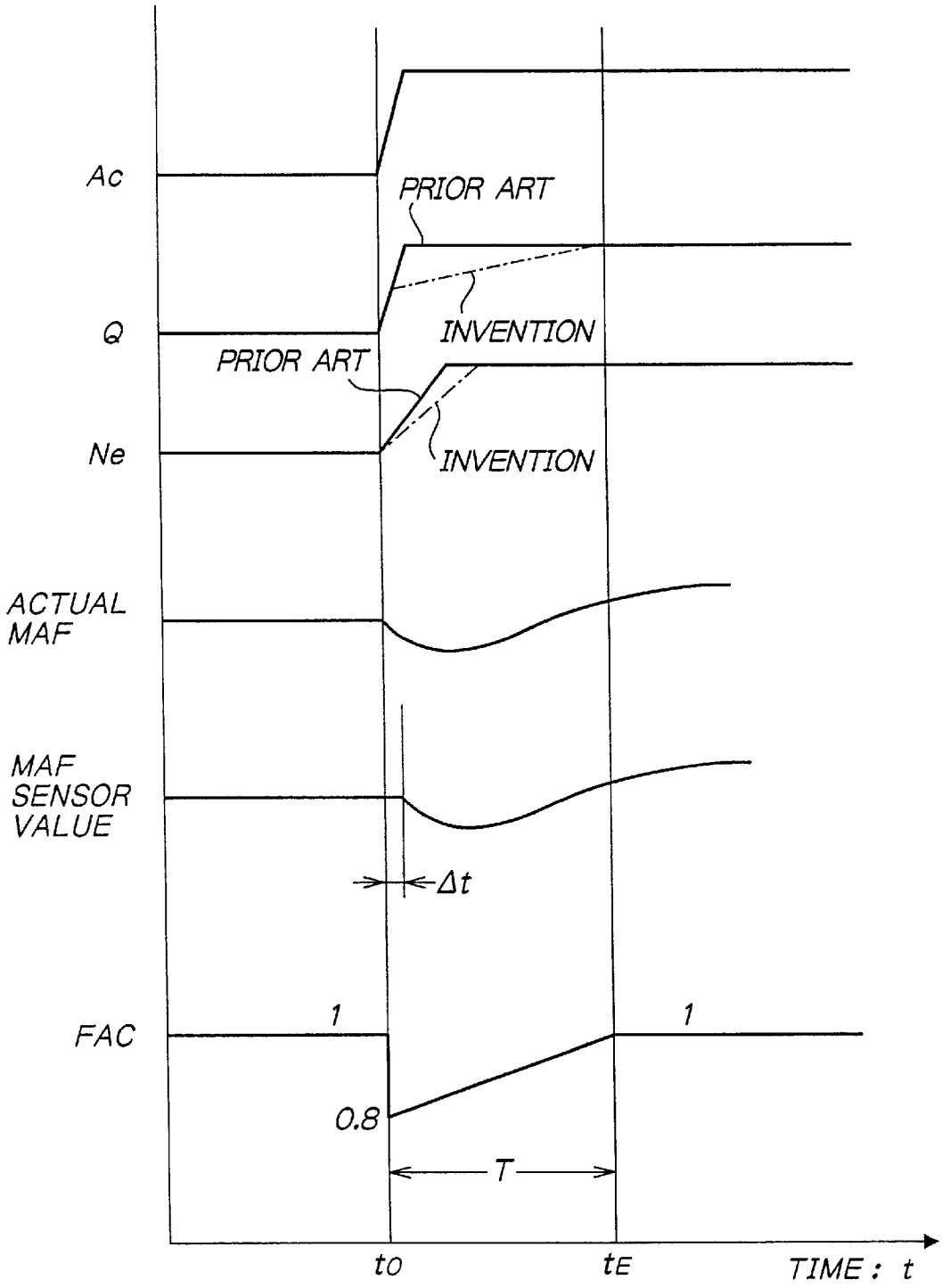
FIG. 6 is a timing chart showing relationship between various values utilized in the control of the invention.

As illustrated in FIGS. 4 and 6, the correction coefficient FAC is updated each time the single routine of control is finished. In the illustrated embodiment, an initial value for correction coefficient is 0.8 ($t=t_0$), and a value "c" is added each time. Specifically, FAC=0.8 at the first routine of control, FAC=0.8+c at the second routine ($t=t_1$), and FAC=0.8+2c at the third routine ($t=t_2$). Addition of "c" is repeated until FAC reaches or exceeds one ($t=t_E$). The initial value and time for addition T ($=t_{E-t0}$) are determined by calibration for each of the engines. The value "c" is determined in accordance with temperature of water flowing in the engine.

As understood from FIG. 3, when the engine is running by itself ($Ne \geqq Nc$), the vehicle speed is zero and the accelerator pedal is stamped ($Ac \neq 0$), then the control program enters the FA mode. As illustrated in FIG. 6, therefore, if the transmission gear is in a neutral position, the vehicle is still, the engine is idling and the accelerator pedal is depressed, then the FA mode is naturally established. It should be assumed that the depression of accelerator pedal starts at the time $t_0$ ($Ac \neq 0$). The correction coefficient FAC at this point is the initial value of 0.8. Therefore, the new maximum amount of fuel injection $Q_{lmt}$ is $0.8 \times Q_{MAF}$. In this manner, the maximum amount of fuel injection is adjusted to a smaller value.

The new maximum amount of fuel injection $Q_{lmt}$ takes a value smaller than $Q_{MAF}$ until the correction coefficient FAC reaches one ($t=t_E$). Because of this, the maximum amount of fuel injection is further limited as compared with a normal way of control (steps 103, 104 and 106). Therefore, even if detection of the intake air flow rate by the MAF sensor 8 causes a delay in the control, an excessive amount of fuel is never injected into the engine combustion chamber. Accordingly, emission of smoke is prevented. Even if the MAF sensor value indicates a value greater than the actual MAF value while the engine revolution speed is rising steeply, the maximum amount of fuel injection is determined in accordance with the actual MAF value. The fuel injection is limited based on this maximum value and the smoke generation is accordingly prevented.

As a result of adjusting the maximum amount of fuel injection to a smaller value for a while (from $t_0$ to $t_E$ in FIG. 6), both of the actual amount of fuel injection Q (equivalent to the target amount of fuel injection $Q_{fnl}$) and engine revolution speed Ne rise gently as indicated by the chain lines in FIG. 6. However, this does not cause any inconvenience since the driver does not intend to move the vehicle in this period.

It should be noted that the present invention is not limited to the illustrated embodiment. For instance, the maximum amount of fuel injection $Q_{MAF}$ may be corrected by the intake air temperature. It is well known that the air density drops as the intake air temperature rises, and therefore a relative amount of fuel injection increases with the intake air temperature. Thus, the maximum amount of fuel injection $Q_{MAF}$ may be decreased as the intake air temperature rises, whereas it may be increased as the intake air temperature drops. Such adjustment results in better control. Further, the maximum amount of fuel injection $Q_{MAF}$ may be determined from the intake air pressure and/or intake air temperature, not depending upon the amount of intake air. Moreover, the way of correcting (decreasing) the maximum amount of fuel injection $Q_{MAF}$ and determining the correction coefficient FAC is not limited to the above described ones. For instance, the subtraction made to the maximum value $Q_{MAF}$ may be performed in accordance with the water temperature. The present invention is also applicable to a fuel injection system of accumulation type (common rail type).

The illustrated and described arrangement and method are disclosed in Japanese Patent Application No. 11-152505 filed on May 31, 1999 in JPO, the instant application claims priority of this Japanese Patent Application, and the entire disclosure thereof is incorporated herein by reference.

What is claimed is:

1. An apparatus for controlling an amount of fuel to be injected into a diesel engine, comprising:

first determination means for determining a basic amount of fuel injection from an engine revolution speed and accelerator opening degree;

second determination means for determining a maximum amount of fuel injection from the engine revolution speed and an intake air flow rate;

third determination means for determining whether a first condition of vehicle speed being zero and a second condition of accelerator opening degree being not zero both hold true;

a correction unit for correcting the maximum amount of fuel injection to a smaller value when both the first and second conditions hold true; and a comparison unit for comparing the basic amount of fuel injection with the corrected maximum amount of fuel injection and selecting the smaller one as a target amount of fuel injection when the first and second conditions hold true, and for comparing the basic amount of fuel injection with the uncorrected maximum amount of fuel injection and selecting the smaller one as the target amount of fuel injection when at least one of the first and second conditions holds untrue.

2. The apparatus of claim 1, wherein the correction unit obtains the corrected maximum amount of fuel injection by multiplying the maximum amount of fuel injection by a correction coefficient less than one.

3. The apparatus of claim 2, wherein the correction coefficient increases with time.

4. The apparatus of claim 1, wherein the first determination means determines the basic amount of fuel injection further in view of at least one of temperature of water flowing in the engine and intake air temperature.

5. The apparatus of claim 1, wherein the second determination means determines the maximum amount of fuel injection such that an air/fuel ratio is close to and below a smoke generation limit over which smoke is generated from the engine.

6. The apparatus of claim 1, wherein the third determination means determines whether the second condition is met by a stroke of accelerator pedal stamped by a driver.

7. A method controlling an amount of fuel to be injected into a diesel engine, comprising the steps of:

A) determining a basic amount of fuel injection from an engine revolution speed and accelerator opening degree;

B) determining a maximum amount of fuel injection from the engine revolution speed and an intake air flow rate;

C) determining whether a first condition of vehicle speed being zero and a second condition of accelerator opening degree being not zero both hold true;

D) correcting the maximum amount of fuel injection to a smaller value when both the first and second conditions hold true;

E) comparing the basic amount of fuel injection with the corrected maximum amount of fuel injection and selecting the smaller one as a target amount of fuel injection when the first and second conditions hold true, and comparing the basic amount of fuel injection with the uncorrected maximum amount of fuel injection and selecting the smaller one as the target amount of fuel injection when at least one of the first and second conditions holds untrue; and F) injecting fuel into the engine in accordance with the target amount of fuel injection.

8. The method of claim 7, wherein the corrected maximum amount of fuel injection is obtained by multiplying the maximum amount of fuel injection by a correction coefficient less than one in the step D.

9. The method of claim 8, wherein the correction coefficient increases with time.

10. The method of claim 7, wherein the basic amount of fuel injection is determined further in view of at least one of temperature of water flowing in the engine and intake air temperature in the step A.

11. The method of claim 7, wherein the maximum amount of fuel injection is determined such that an air/fuel ratio be close to and below a smoke limit over which smoke is generated from the engine in the step B.

12. The method of claim 7, wherein the step C includes the substep of detecting a stroke of accelerator pedal stamped by a driver in order to determine whether the second condition is met.

* * * * *